US009576545B2

(12) United States Patent
Lv et al.

(10) Patent No.: US 9,576,545 B2
(45) Date of Patent: Feb. 21, 2017

(54) DRIVING CIRCUIT, FLEXIBLE DISPLAY DEVICE AND FLEXIBLE SPLICING DISPLAY APPARATUS THEREOF

(71) Applicant: SHENZHEN CHINA STAR OPTOELECTRONICS TECHNOLOGY CO., LTD., Shenzhen, Guangdong (CN)

(72) Inventors: Xiaowen Lv, Guangdong (CN); Chih-Yu Su, Guangdong (CN); Chih Hao Wu, Guangdong (CN)

(73) Assignee: SHENZHEN CHINA STAR OPTOELECTRONICS TECHNOLOGY CO., LTD., New District Shenzhen, Guangdong (CN)

( * ) Notice: Subject to any disclaimer, the term of this patent is extended or adjusted under 35 U.S.C. 154(b) by 41 days.

(21) Appl. No.: 14/387,966

(22) PCT Filed: Jun. 19, 2014

(86) PCT No.: PCT/CN2014/080334
§ 371 (c)(1),
(2) Date: Sep. 25, 2014

(87) PCT Pub. No.: WO2015/180219
PCT Pub. Date: Dec. 3, 2015

(65) Prior Publication Data

US 2015/0364070 A1 Dec. 17, 2015

(30) Foreign Application Priority Data

May 31, 2014 (CN) ..... 2014 1 0240577

(51) Int. Cl.
*G09G 3/36* (2006.01)

(52) U.S. Cl.
CPC ..... *G09G 3/3685* (2013.01); *G09G 2300/026* (2013.01); *G09G 2300/0426* (2013.01);
(Continued)

(58) Field of Classification Search
None
See application file for complete search history.

(56) References Cited

U.S. PATENT DOCUMENTS 7,489,337 B2 * 2/2009 Houmeau ..... H04N 9/12 345/1.3
2007/0040953 A1 2/2007 Huang et al.
(Continued)

FOREIGN PATENT DOCUMENTS

CN 101666951 A 3/2010
CN 102568321 A 7/2012

*Primary Examiner* — Nicholas Lee
(74) *Attorney, Agent, or Firm* — Hauptman Ham, LLP

(57) ABSTRACT

A driving circuit, flexible display device and flexible splicing display apparatus thereof are described. The driving circuit comprises a driving chip, a plurality of data signal wires and a plurality of scan signal wires. The data signal wires of the flexible display device and the data lines are connected correspondingly within the display region of the flexible display device, and the scan signal wires and the scan lines are connected correspondingly in one side of the driving chip of the flexible display device. The present invention utilizes the arrangement of connection pads of the signal wires to improve the display quality of the flexible display device.

6 Claims, 5 Drawing Sheets

(52) U.S. Cl.
CPC ..... *G09G 2310/0278* (2013.01); *G09G 2320/0242* (2013.01); *G09G 2320/0276* (2013.01); *G09G 2320/0666* (2013.01); *G09G 2320/0673* (2013.01); *G09G 2380/02* (2013.01)

(56) References Cited

U.S. PATENT DOCUMENTS

| | | | | |
|---|---|---|---|---|
| 2010/0200278 | A1 | 8/2010 | Wang | |
| 2011/0057861 | A1* | 3/2011 | Cok | H01L 27/3293 345/1.3 |
| 2011/0080388 | A1* | 4/2011 | Lo | G09G 3/20 345/205 |
| 2012/0313907 | A1 | 12/2012 | Yamazaki | |

* cited by examiner

DRIVING CIRCUIT, FLEXIBLE DISPLAY DEVICE AND FLEXIBLE SPLICING DISPLAY APPARATUS THEREOF

FIELD OF THE INVENTION

The present invention relates to a display technique, and more particularly to a driving circuit, flexible display device and flexible splicing display apparatus thereof.

BACKGROUND OF THE INVENTION

With the technical development and better living standards, people would definitely have increasingly high expectations in terms of liquid crystal display (LCD). To satisfy the large LCD demands of some people and the requirement of some promotional event activities, a few of conventional LCDs are spliced and merged to form a large size display apparatus composed of the LCDs.

FIG. 1 is a structural schematic view of a conventional flexible display device 10 in the flexible splicing display apparatus. The flexible display device 10 includes data lines 11, scan lines 12 and pixel units 13 composed of interlaced data lines 11 and scan lines 12. The driving chips 14 provides the data signals to the data lines 11 respectively by the data signal wire 15 and provides scan signals to the scan lines 12 respectively by the scan signal wire 16.

In FIG. 1, the connection pads of the data lines 11 and the data signal wire 15 of the flexible display device 10 are disposed in one side of the driving chip 14 of flexible display device 10, and the connection pads of the scan lines 12 and the scan signal wire 16 are disposed in two other sides of the flexible display device 10. Thus, the three sides of the flexible display device 10 includes the connection pads which disadvantageously downgrades the display quality. When the flexible display devices 10 are spliced to form the conventional flexible splicing display apparatus, the side with the connection pads affects the display status of the connection region. As a result, the display quality of the flexible splicing display apparatus composed of the flexible display devices 10 is poor.

Consequently, there is a need to develop a novel of driving circuit, flexible display device and flexible splicing display apparatus to solve the aforementioned issues.

SUMMARY OF THE INVENTION

One objective of the present invention is to provide a driving circuit, flexible display device and flexible splicing display apparatus thereof to solve the problems of arrangement of connection pads of the signal wires which downgrades the display quality of the flexible display device of the flexible splicing display apparatus.

According to the above objective, the present invention sets forth a driving circuit, flexible display device and flexible splicing display apparatus thereof.

The driving circuit for driving a flexible display device including a plurality of pixel units, interlacedly formed by a plurality of data lines and a plurality of scan lines, the driving circuit comprises:

a driving chip for generating data signals and scan signals;

a plurality of data signal wires for sending the data signals to the data lines correspondingly; and a plurality of scan signal wires for sending the scan signals to the scan lines correspondingly;

wherein the data signal wires of the flexible display device and the data lines are connected correspondingly within the display region of the flexible display device, and the scan signal wires and the scan lines are connected correspondingly in one side of the driving chip of the flexible display device; or wherein the scan signal wires of the flexible display device and the scan lines are connected correspondingly within the display region of the flexible display device, and the data signal wires and the data lines are connected correspondingly in one side of the driving chip of the flexible display device.

In one embodiment, the data signal wires of the flexible display device and the data lines are connected correspondingly within the display region of the flexible display device, and wherein the data signal wires of the flexible display device are led into one side of the driving chip to be connected to the data lines.

In one embodiment, the data signal wires and the scan signal wires are interlaced to be from the driving chip.

In one embodiment, the scan signal wires of the flexible display device and the scan lines are connected correspondingly within the display region of the flexible display device, and wherein the scan signal wires of the flexible display device are led into one side of the driving chip to be connected to the scan lines.

In one embodiment, the data signal wires and the scan signal wires are interlaced to be from the driving chip.

In one preferred embodiment, a flexible display device of the present invention comprises:

a plurality of pixel units, interlacedly formed by a plurality of data lines and a plurality of scan lines wherein data signals are transmitted to the pixel units correspondingly, and scan signals are transmitted to the pixel units correspondingly;

a driving chip for generating the data signals and the scan signals;

a plurality of data signal wires for sending the data signals to the data lines correspondingly; and a plurality of scan signal wires for sending the scan signals to the scan lines correspondingly;

wherein the data signal wires of the flexible display device and the data lines are connected correspondingly within the display region of the flexible display device, and the scan signal wires and the scan lines are connected correspondingly in one side of the driving chip of the flexible display device; or wherein the scan signal wires of the flexible display device and the scan lines are connected correspondingly within the display region of the flexible display device, and the data signal wires and the data lines are connected correspondingly in one side of the driving chip of the flexible display device.

In one embodiment, the data signal wires of the flexible display device and the data lines are connected correspondingly within the display region of the flexible display device, and wherein the data signal wires of the flexible display device are led into one side of the driving chip to be connected to the data lines.

In one embodiment, the data signal wires and the scan signal wires are interlaced to be from the driving chip.

In one embodiment, the scan signal wires of the flexible display device and the scan lines are connected correspondingly within the display region of the flexible display device, and wherein the scan signal wires of the flexible display device are led into one side of the driving chip to be connected to the scan lines.

In one embodiment, the data signal wires and the scan signal wires are interlaced to be from the driving chip.

In one preferred embodiment, a flexible splicing display apparatus having a plurality of flexible display devices, each of the flexible display devices comprising:

a display region, disposed in a central portion of the flexible display device for displaying the image screen correspondingly; and a connection region, disposed in the two display regions;

wherein flexible display device, comprising: a plurality of pixel units, interlacedly formed by a plurality of data lines and a plurality of scan lines wherein data signals are transmitted to the pixel units correspondingly, and scan signals are transmitted to the pixel units correspondingly; a driving chip for generating the data signals and the scan signals; a plurality of data signal wires for sending the data signals to the data lines correspondingly; and a plurality of scan signal wires for sending the scan signals to the scan lines correspondingly; wherein the data signal wires of the flexible display device and the data lines are connected correspondingly within the display region of the flexible display device, and the scan signal wires and the scan lines are connected correspondingly in one side of the driving chip of the flexible display device; or wherein the scan signal wires of the flexible display device and the scan lines are connected correspondingly within the display region of the flexible display device, and the data signal wires and the data lines are connected correspondingly in one side of the driving chip of the flexible display device.

wherein the connection region is formed by overlapping two edge portions of two flexible display devices; wherein the gamma values of the connection regions between two display regions is ensured based on the gamma values of the two display regions respectively, and the colorimetric values of the connection regions between two display regions is ensured based on the colorimetric values of the two display regions respectively.

In one embodiment, the connection region comprises: a first connection, being adjacent to the first display region near the connection region; a second connection region, being adjacent to the second display region near the connection region;

wherein the connection region is disposed between the first display region and the second display region; wherein a gamma value of the first connection region is the same as a gamma value of the first display region, and a gamma value of the second connection region is the same as a gamma value of the second display region; wherein a color hue value of the first connection region is the same as a color hue value of the first display region, and a color hue value of the second connection region is the same as a color hue value of the second display region.

In one embodiment, the a size of the first connection region is the same as a size of the second connection region.

In one embodiment, the gamma value of the connection region is set by adjusting the gamma value of the connection region near at least one edge portion of the flexible display device.

In one embodiment, the color hue value of the connection region is set by adjusting the color hue value of the connection region near at least one edge portion of the flexible display device.

In one embodiment, the data signal wires of the flexible display device and the data lines are connected correspondingly within the display region of the flexible display device, and wherein the data signal wires of the flexible display device are led into one side of the driving chip to be connected to the data lines.

In one embodiment, the data signal wires and the scan signal wires are interlaced to be from the driving chip.

In one embodiment, the scan signal wires of the flexible display device and the scan lines are connected correspondingly within the display region of the flexible display device, and wherein the scan signal wires of the flexible display device are led into one side of the driving chip to be connected to the scan lines.

In one embodiment, the data signal wires and the scan signal wires are interlaced to be from the driving chip.

In comparison with the conventional manner, the driving circuit, flexible display device and flexible splicing display apparatus thereof of the present invention to solve the problems of arrangement of connection pads of the signal wires which downgrades the display quality of the flexible display device of the flexible splicing display apparatus.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
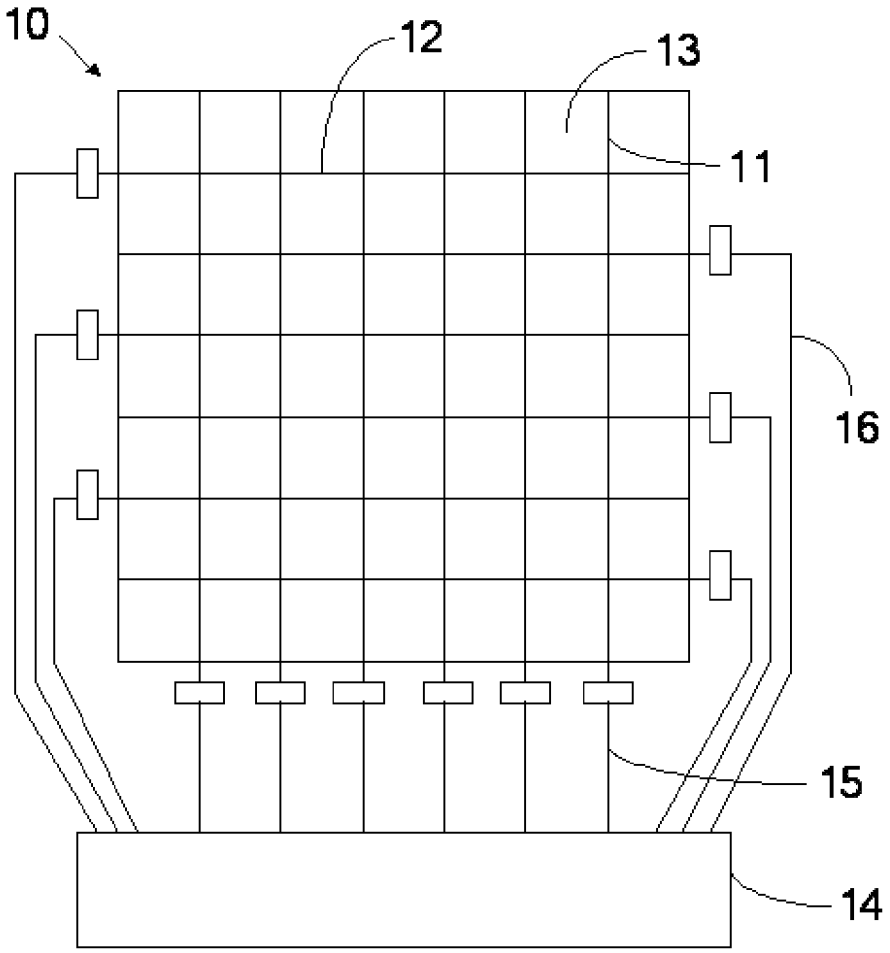
FIG. 1 is a structural schematic view of a conventional flexible display devices in the flexible splicing display apparatus.

The following descriptions of the respective embodiments are specific embodiments capable of being implemented as illustrations of the present invention, with reference to the appended figures. The terms up, down, front, rear, left, right, interior, exterior, side, etcetera are merely directions referring to the appended figures. Therefore, such directions are employed for explaining and understanding the present invention, but are not limitations thereto. In the drawings, similar structures are represented by the same symbols.

Figure 2:
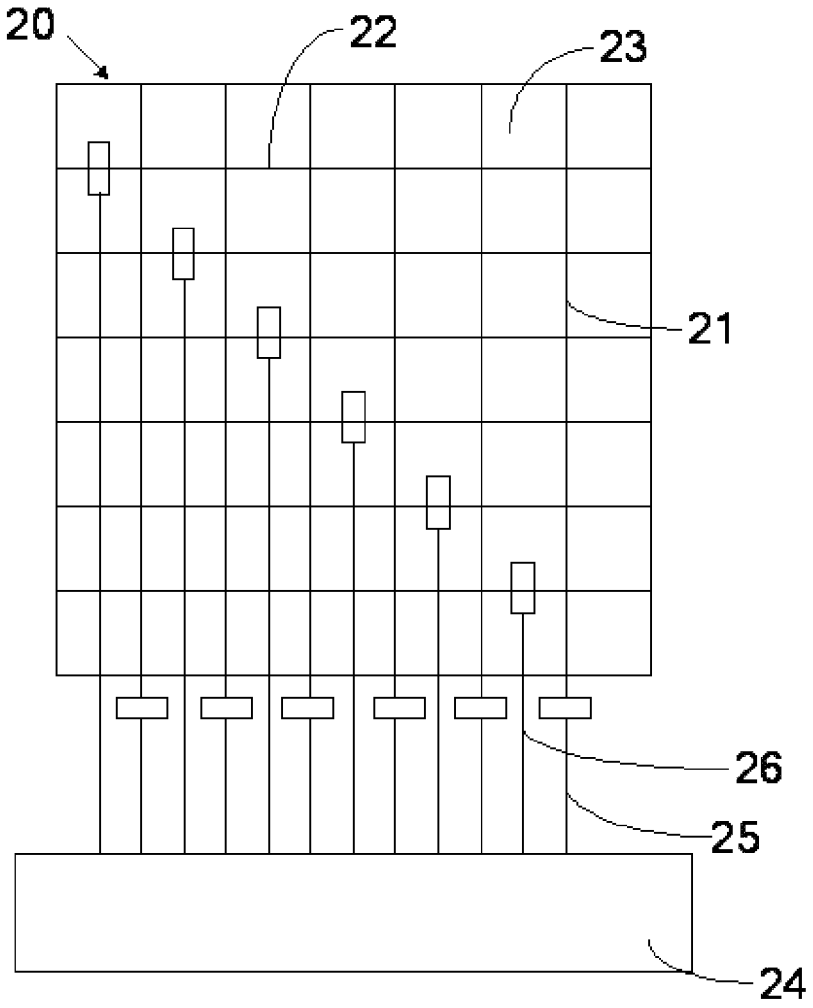
FIG. 2 is a structural schematic view of a plurality of flexible display devices in the flexible splicing display apparatus according to a first preferred embodiment of the present invention.

FIG. 2 is a structural schematic view of a plurality of flexible display devices 20 in the flexible splicing display apparatus according to a first preferred embodiment of the present invention. The flexible display device 20 includes pixel units 23, scan lines 22, data lines 21, a driving chip 24, data signal wires 25, scan signal wires 26.

The pixel units 23 are formed by the interlaced scan lines 22 and data lines 21. The data lines 21 transmit the data signal to the pixel units 23 and the scan lines 22 transmit the scan signal to the pixel units 23. The driving chip 24 generates the data signals and scan signal. The data signal wire 25 is used to send the data signal to the data lines 21 correspondingly and the scan signal wire 26 is used to send the scan signal to the scan lines 22 correspondingly.

In one preferred embodiment, the data signal wires 25 of the flexible display device 20 and the data lines 21 are connected correspondingly within the display region of the flexible display device 20. The scan signal wires 26 and the scan lines 22 are connected correspondingly in one side of the driving chip 24 of the flexible display device 20. Further, the data signal wires 25 are connected to the one side of the driving chip 24 of the flexible display device 20. In this manner, the flexible display device 20 advantageously includes one side having the connection pads of the signal wires. Thus, while the flexible display devices 20 are spliced, only one side of flexible display device 20 may affect the spliced status of the flexible splicing display apparatus, which effectively improve the display quality of the flexible splicing display apparatus composed of flexible display devices 20.

In one preferred embodiment, the data signal wires 25 and the scan signal wires 26 of the flexible display device 20 are led from the driving chip 24 so that the data signal wires 25 and the scan signal wire 26 are not intersected to increase the stability of the output signal of the data signals and the scan signals.

Figure 3:
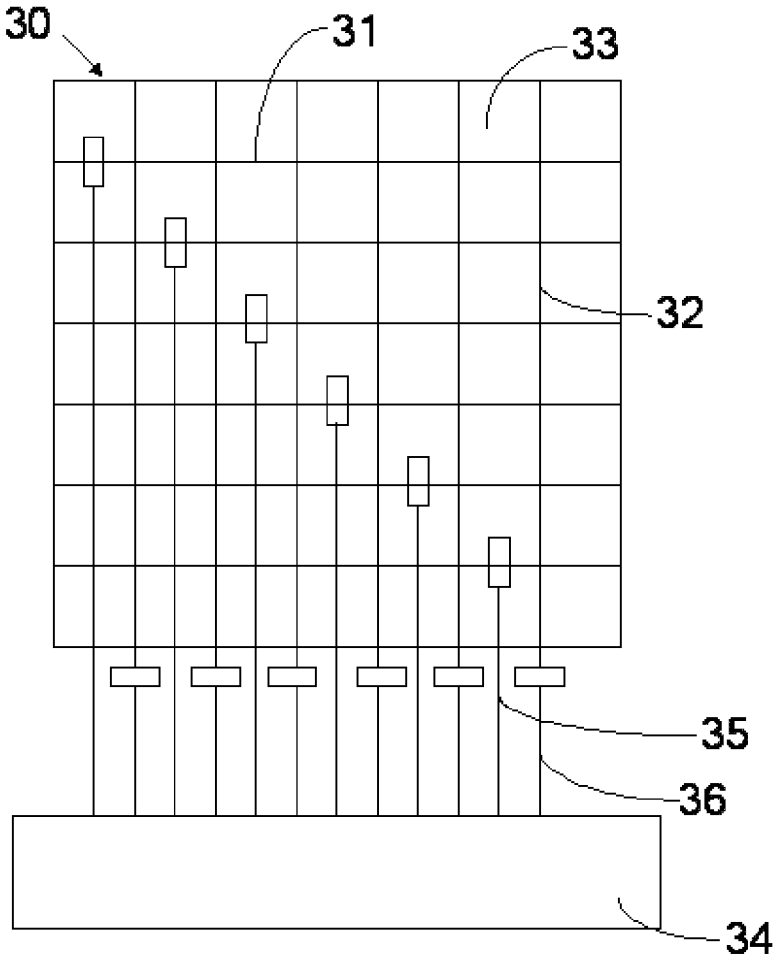
FIG. 3 is a structural schematic view of a plurality of flexible display devices in the flexible splicing display apparatus according to a second preferred embodiment of the present invention.

FIG. 3 is a structural schematic view of a plurality of flexible display devices in the flexible splicing display apparatus according to a second preferred embodiment of the present invention. The flexible display device 30 includes pixel units 33, scan lines 32, data lines 31, a driving chip 34, data signal wires 35, scan signal wires 36.

The pixel units 33 are formed by the interlaced scan lines 32 and data lines 31. The data lines 31 transmit the data signal to the pixel units 33 and the scan lines 32 transmit the scan signal to the pixel units 33. The driving chip 34 generates the data signals and scan signal. The data signal wire 35 is used to send the data signal to the data lines 31 correspondingly and the scan signal wire 36 is used to send the scan signal to the scan lines 32 correspondingly.

In one preferred embodiment, the data signal wires 35 of the flexible display device 30 and the data lines 31 are connected correspondingly within the display region of the flexible display device 30. The scan signal wire 36 and the scan lines 32 are connected in one side of the driving chip 34 of the flexible display device 30. Further, the data signal wires 35 are connected to the one side of the driving chip 34 of the flexible display device 30. In this manner, the flexible display device 30 advantageously includes one side having the connection pads of the signal wires. Thus, while the flexible display devices 30 are spliced, only one side of flexible display device 30 may affect the spliced status of the flexible splicing display apparatus, which effectively improve the display quality of the flexible splicing display apparatus composed of flexible display devices 30.

In one preferred embodiment, the data signal wires 35 and the scan signal wire 36 of the flexible display device 30 are led from the driving chip 34 so that the data signal wires 35 and the scan signal wire 36 are not intersected to increase the stability of the output signal of the data signals and the scan signals.

Figure 4:
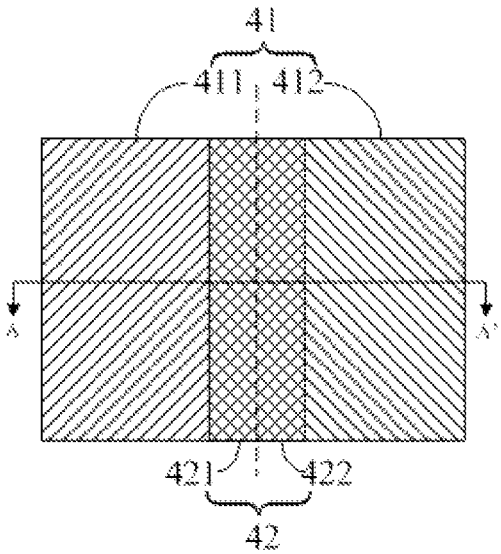
FIG. 4 is a structural schematic view of a flexible splicing display apparatus according to one preferred embodiment of the present invention.
Figure 5:
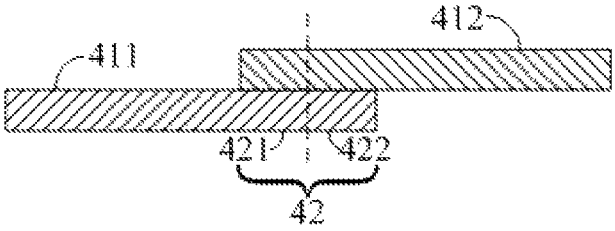
FIG. 5 is a cross-sectional view of flexible splicing display apparatus along line A-A' of FIG. 1 according to one embodiment of the present invention.

Please refer to FIGS. 4 and 5. FIG. 4 is a structural schematic view of a flexible splicing display apparatus according to one preferred embodiment of the present invention. FIG. 5 is a cross-sectional view of flexible splicing display apparatus along line A-A' of FIG. 4 according to one embodiment of the present invention. In FIG. 4, the flexible splicing display apparatus is composed of a plurality of flexible display devices and comprises display regions 41 and connection regions 42 wherein each of the display regions 41 is disposed in the central portion of the corresponding flexible display device for displaying the image screen and each of the connection regions 42 is disposed in the two adjacent display regions 41.

Specifically, the connection regions 42 is formed by overlapping the edge portions of the adjoining flexible display devices. Thus, the connection regions 42 includes the edge portions of two flexible display devices and one edge portion of one flexible display device is overlaid on the other edge portion of the other one flexible display device.

To improve the display quality in the transitional display region 41 of two flexible display devices, the gamma values of the connection regions 42 between two display regions 41 is detected based on the gamma values of the two display regions 41 respectively in the preferred embodiment of the present invention. The colorimetric values of the connection regions 42 between two display regions 41 is detected based on the colorimetric values of the two display regions 41 respectively. The gamma values represents the either darkness or brightness in the display regions 42 and the colorimetric values represents the color hue and the saturation level in the connection regions 42.

The brightness values and color hue values of the connection regions 42 can be set between the brightness values and color hue values of the adjacent display regions 41. In other words, the brightness values of the connection regions 42 are set between the brightness values of the adjacent display regions 41, and the color hue values of the connection regions 42 are set between the color hue values of the adjacent display regions 41. Such a manner, the deviation of brightness and color hue in the connection region 42 corresponding to two adjacent display regions 41 is prevented from the discontinuous display screen between the display regions 41.

Specifically, each connection region 42 is divided into a first connection region 421 and a second connection region 422. The connection region 42 is disposed between the first display region 411 and the second display region 412. The first connection region 421 is adjacent to the first display region 411 and second connection region 422 is adjacent to the second display region 412. In this manner, the gamma value of the first connection region 421 is set by the gamma value of the first display region 411, and the gamma value of the second connection region 422 is set by the gamma value of the second display region 412. The color hue value of the first connection region 421 is set by the color hue value of the first display region 411, and the color hue value of the second connection region 422 is set by the color hue value of the second display region 412. Therefore, the first display region 411 seamlessly connects to the second display region 412 to prevent the adjacent display regions 41 from the discontinuous display screen.

In another embodiment, the connection region 42 is divided into more than two connecting regions 42 and gamma values and color hue values of the connecting regions 42 are gradually changed. That is, the gamma value of the connecting region 42 which lies closest to the first display region 411 is equal or similar to the gamma value of the first display region 411, and the color hue value of the connecting region 42 which lies closest to the first display region 411 is equal or similar to the color hue value of the first display region 411. The gamma value of the connecting region 42 which lies closest to the second display region 412 is equal or similar to the gamma value of the second display region 412, and the color hue value of the connecting region 42 which lies closest to the second display region 412 is equal or similar to the color hue value of the second display region 412.

In one preferred embodiment, in order to uniform the size of the display regions 41 of the flexible display devices in the flexible splicing display apparatus, the sizes of the first connection region 421 and a second connection region 422 may be identical to improve the display quality of the flexible display devices.

In one embodiment, while the flexible splicing display apparatus displays a image screen, the gamma value of the connection region 42 is set by adjusting the gamma value of the connection region 42 near one edge portion of the flexible display device and/or the gamma value of the connection region 42 is set by adjusting the gamma value of the connection region 42 near two edge portions of the flexible display device. It should be noted that the setting of the gamma value of the connection region 42 depends on the requirement of the designers.

In another embodiment, while the flexible splicing display apparatus displays a image screen, the color hue value of the connection region 42 is set by adjusting the color hue value of the connection region 42 near one edge portion of the flexible display device and/or the color hue value of the connection region 42 is set by adjusting the color hue value of the connection region 42 near two edge portions of the flexible display device. It should be noted that the setting of the color hue value of the connection region 42 depends on the requirement of the designers.

According to the above-mentioned descriptions of the present invention, the gamma values of the connection regions between two display regions is ensured based on the gamma values of the two display regions respectively, which improves the brightness and color hue continuations between two adjacent display regions. Further, the connection pads of the data signal wires and data lines of the flexible display devices of the flexible splicing display apparatus, and/or the connection pads of the scan signal wires and scan lines of the flexible display devices of the flexible splicing display apparatus are disposed in one side to increase the display quality of the flexible splicing display apparatus for solving the problems of lower brightness and deviation of colors which occurs in the overlapped regions of the OLED flexible display devices.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A flexible splicing display apparatus having a plurality of flexible display devices, each of the flexible display devices comprising:

a display region, disposed in a central portion of the flexible display device for displaying the image screen correspondingly; and a connection region, disposed in the two display regions;

wherein the flexible display device, comprising:

a plurality of pixel units, interlacedly formed by a plurality of data lines and a plurality of scan lines wherein data signals are transmitted to the pixel units correspondingly, and scan signals are transmitted to the pixel units correspondingly;

a driving chip for generating the data signals and the scan signals;

a plurality of data signal wires for sending the data signals to the data lines correspondingly; and a plurality of scan signal wires for sending the scan signals to the scan lines correspondingly;

wherein the scan signal wires of the flexible display device and the scan lines are connected correspondingly within the display region of the flexible display device, and the data signal wires and the data lines are connected correspondingly in one side of the driving chip of the flexible display device, wherein the connection region is formed by overlapping two edge portions of two flexible display devices;

wherein the gamma values of the connection regions between two display regions is ensured based on the gamma values of the two display regions respectively, and the colorimetric values of the connection regions between two display regions is ensured based on the colorimetric values of the two display regions respectively;

wherein the connection region comprises:

a first connection, being adjacent to the first display region near the connection region; and a second connection region, being adjacent to the second display region near the connection region, wherein the connection region is disposed between the first display region and the second display region, a gamma value of the first connection region is the same as a gamma value of the first display region, and a gamma value of the second connection region is the same as a gamma value of the second display region, and a color hue value of the first connection region is the same as a color hue value of the first display region, and a color hue value of the second connection region is the same as a color hue value of the second display region.

2. The flexible splicing display apparatus of claim 1, wherein a size of the first connection region is the same as a size of the second connection region.

3. The flexible splicing display apparatus of claim 1, wherein the gamma value of the connection region is set by adjusting the gamma value of the connection region near at least one edge portion of the flexible display device.

4. The flexible splicing display apparatus of claim 1, wherein the color hue value of the connection region is set by adjusting the color hue value of the connection region near at least one edge portion of the flexible display device.

5. The flexible splicing display apparatus 1, wherein the scan signal wires of the flexible display device and the scan lines are connected correspondingly within the display region of the flexible display device, and wherein the scan signal wires of the flexible display device are led into one side of the driving chip to be connected to the scan lines.

6. The flexible splicing display apparatus 5, wherein the data signal wires and the scan signal wires are interlaced to be from the driving chip.

* * * * *